United States Patent [19]

Schaerer

[11] Patent Number: 4,750,639

[45] Date of Patent: Jun. 14, 1988

[54] ARRANGEMENT FOR THE PRE-SORTING OF GARBAGE

[75] Inventor: Emil A. Schaerer, Zürich, Switzerland

[73] Assignee: Emil Schaerer & Co., Kusnacht, Switzerland

[21] Appl. No.: 916,812

[22] Filed: Oct. 8, 1986

[30] Foreign Application Priority Data

Oct. 9, 1985 [CH] Switzerland ..... 04357/85

[51] Int. Cl.[4] ..... B65D 33/02

[52] U.S. Cl. ..... 220/410; 383/38; 206/459

[58] Field of Search ..... 383/38, 6; 220/408, 220/410, 20, 23.83, 23.86, 23.4; 206/459

[56] References Cited

U.S. PATENT DOCUMENTS

| | | | |
|---|---|---|---|
| 4,094,351 | 6/1978 | Catenaccio | 383/38 |
| 4,127,155 | 11/1978 | Hydorn | 383/38 |
| 4,542,826 | 9/1985 | Adams | 383/38 |
| 4,646,804 | 3/1987 | Damiano | 383/38 |

*Primary Examiner*—Joseph M. Moy

*Attorney, Agent, or Firm*—Karl F. Ross; Herbert Dubno

[57] ABSTRACT

The arrangement for the pre-sorting of household garbage comprises replaceable garbage sacks which consist of at least two sectional sacks having different distinguishing marking and forming separate garbage compartments which can be separated from each other. As a result of these steps it is possible to pre-sort resulting refuse consumer-just even more carefully and extensively in order to then dispose of the garbage components through recycling, decomposition and more ecologically-favourable incineration.

7 Claims, 1 Drawing Sheet

FIG. 1
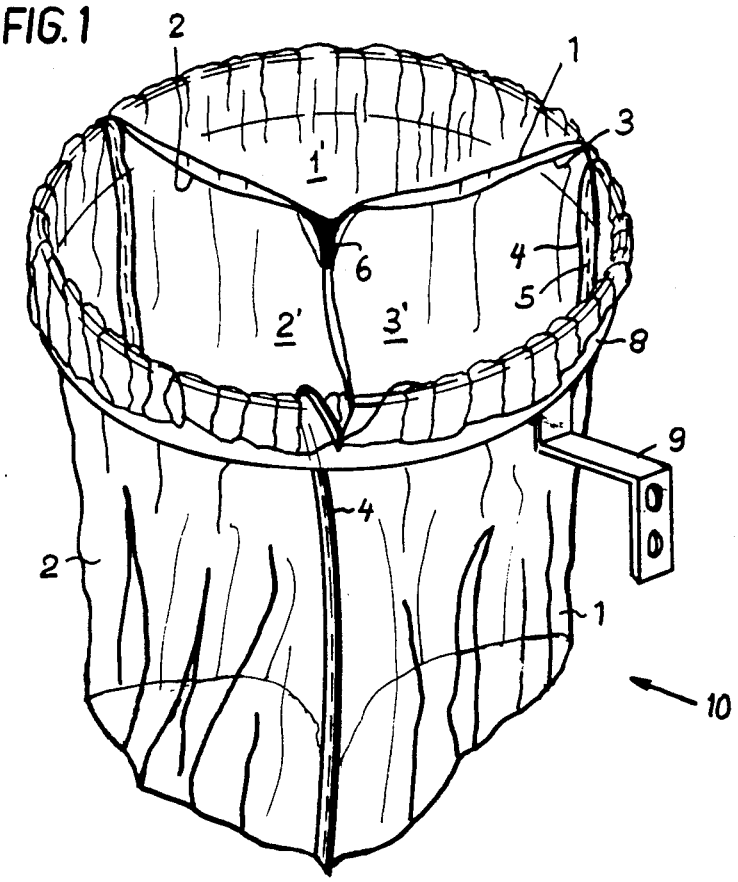
FIG. 3
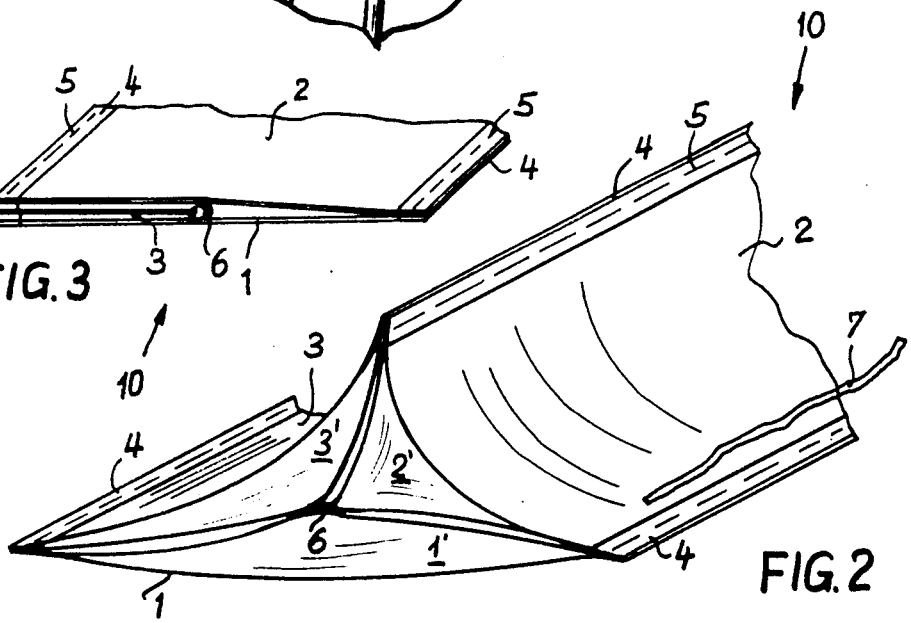
FIG. 2

ARRANGEMENT FOR THE PRE-SORTING OF GARBAGE

FIELD OF THE INVENTION

My present invention relates to an arrangement for the pre-sorting of garbage, in particular household garbage, with replaceable garbage sacks, in particular plastic sacks.

BACKGROUND OF THE INVENTION

From research reports from all over the world, it is evident that refuse disposal on our latitude has reached a critical phase. It is therefore necessary to increase the efforts required to bring the resulting gigantic mountains of waste to the natural material cycles again.

For this there is universal willingness, as the successful recycling of glass and newspaper show.

In addition to this, however, it is apparent that the refuse in households, collected in still unseparated condition, contains too many problem materials for the household garbage to be able to be returned more or less directly to a natural material cycle, for example, by decomposition.

Hence it follows that refuse can be composted only if it can be separated into biogenous and other components. In order to fulfil these requirements of quality, it is unavoidable but to collect the various garbage components in separated form at the household.

Aside from the used glass and paper collection, it has already been proposed to use various boxes with insertion sacks of different color to collect decomposable and other refuse in the household.

Such boxes involve, however, high purchase costs, create considerable space problems and demand an adaptation of the users' former habits in handling, aside from the holding and swiveling devices of existing waste bins in kitchen units which would then be of no use.

OBJECT OF THE INVENTION

The object of my present invention is, therefore, to provide a means for the pre-sorting of household garbage in particular, which meets all requirements necessary for separating the refuse components already in the household without on the whole interfering in the manner of handling to which the user is accustomed, and without having to dispense with existing containers and frame devices.

SUMMARY OF THE INVENTION

These objects and others which will become more readily apparent hereinafter are attained in an arrangement or unit for the pre-sorting of garbage, in particular household garbage, with replaceable sacks, in particular plastic sacks.

I realize this object in accordance with my present invention by the fact that the garbage sacks consist of at least two sectional sacks having different color and forming separate garbage compartments which can be separated from each other.

In this connection, an advantageous embodiment of the garbage sacks exists by the sectional sacks each having two diametrically-opposite, axially-parallel perforation welts with perforations, on which the other neighbouring sectional sacks are joined detachable together and, moreover, that the sectional sacks are joined punctiform at their mutual, central wall contact at the upper opening edge.

Further, it is of advantage when several of the garbage sacks, consisting in each case of at least two sectional sacks, are folded flat and rolled up to form a supply roll.

In this case it is appropriate for each sectional sack to be furnished with a string for binding.

As a result of these steps, the user can now keep his existing garbage-sack facilities and, as before, take a garbage sack from the roll, open it and insert it by folding over the upper edge, with which, then, several separate garbage compartments for different kinds of refuse are at his disposal.

After being filled, the sectional sacks are separated from each other by pulling them apart at the perforation, and then tied up as individual sacks and placed ready for the garbage collection.

BRIEF DESCRIPTION OF THE DRAWING

The above and other objects, features and advantages of my invention will become more readily apparent from the following description, reference being made to the accompanying highly diagrammatic drawing in which:

FIG. 1 illustrates in perspective view an arrangement for the pre-sorting of household garbage with a garbage sack according to the invention;

FIG. 2 is a perspective detail representation of a garbage sack according to the invention in a slightly folded condition; and FIG. 3 is a perspective detail representation of a garbage sack according to the invention in folded condition.

SPECIFIC DESCRIPTION

The garbage sack 10 for usage in existing arrangements, such as the usual waste bin or with a holder 8 or the like mounted with an assembly bracket 9 on the door of a kitchen unit (not shown), and preferably made of an ecologically beneficial plastics material consists, according to the invention, of at least two, here, as an exemplary embodiment, three, section-forming sacks, 1,2 and 3.

Such a garbage sack can be taken in the usual way from the roll, opened up and inserted in the holder 8, whereupon the upper edge of the garbage sack is folded over the holder, inside out.

It is of advantage for the sectional sacks 1,2 and 3 of FIG. 1, which form separate garbage compartments 1',2' and 3', to be of different colors, for example green for decomposable kitchen refuse, red for combustible refuse and yellow for hard materials such as cans and the like.

Instead of marking by color, the sectional sacks may also be differentiated in other ways, for example, by graphic representation and symbols and/or by material-indicative inscription.

The sectional sacks 1,2 and 3 each possess two diametrically-opposite, axially-parallel perforation welts 4 with perforations 5, on which the other neighbouring sectional sacks are joined detachably together by adhesion, welding or the like, as is shown in FIGS. 2 and 3 in particular.

Furthermore, of FIGS. 1,2 and 3 show that the sectional sacks 1,2 and 3 are, moreover, joined punctiform at their mutual, central wall contact at the upper opening edge by a spot welding 6, for instance.

In the usual manner, each sectional sack is furnished with tie such as a string 7 (FIG. 2), and the garbage sacks 10, consisting of the sectional sacks 1,2 and 3, are folded flat together, as in FIGS. 2 and 3, in order to roll them onto a supply roll. Of course, the folded-flat garbage sacks 10 may also be stacked to form multipacks.

The garbage sacks 10 can, moreover, be joined in the usual way "endless" in a row, detachably joined together by perforated strips. The garbage sacks 10 may be manufactured for any desired volume, for example, 35 or 60 lt. The sectional sacks may in this case be of the same or different partial volumes. As desired, each garbage sack may comprise two, three or more sectional sacks.

As a result of the arrangement for the pre-sorting of garbage, a separate trash disposal is achieved under optimal psychological prerequisites for the user, namely, an environmental conciousness without making any great change in habits visible.

While there are shown and described preferred embodiments of the invention, it is to be distinctly understood that the invention is not limited thereto but may be embodied and practised without the scope of the following claims.

What I claim is:

1. A household-garbage disposal system, comprising:

a household holder; and a disposable garbage sack replaceably receivable in said holder, said garbage sack including:

at least two sack sections composed of plastic and having respective openings at an upper side of said garbage sack, means for detachably connecting said sack sections together at flexible walls of said sack sections to form said garbage sack whereby each of said sections upon separation from along said means constitutes a self-contained bag for disposal of a particular kind of refuse, and distinguishing markings on said sack sections for enabling the sorting of different kinds of refuse into the respective sack sections based upon said markings.

2. The household-garbage disposal system defined in claim 1 wherein said means for detachably connecting said sack sections together at flexible walls of said sack sections includes a perforation welt joining each two adjacent ones of said sack sections, and perforations formed in said welt enabling separation of the adjacent ones of said sack sections.

3. The household-garbage disposal system defined in claim 2 wherein at least three said sack sections form said sack and said sack sections adjoin at a common central region of said sack, said sack being further formed with a punctiform junction between said sack sections at said region.

4. The household-garbage disposal system defined in claim 1 wherein at least three said sack sections form said sack and said sack sections adjoin at a common central region of said sack, said sack being further formed with a punctiform junction between said sack sections at said region.

5. The household-garbage disposal system defined in claim 1 wherein said garbage sack is provided in a flat unit from a supply roll from which aid flat unit is detached.

6. The household-garbage disposal system defined in claim 1 wherein each of said sack sections is provided at an upper portion with a tie for closing the mouth of the respective bag.

7. The household-garbage disposal system defined in claim 6 wherein each of said ties is a string on an upper edge of the respective sack section.

* * * * *